US007086837B2

(12) United States Patent
Kamoshita et al.

(10) Patent No.: US 7,086,837 B2
(45) Date of Patent: Aug. 8, 2006

(54) CENTRIFUGAL BLOWER FAN

(75) Inventors: Tadashi Kamoshita, Nishi-Tokyo (JP); Giichi Iida, Tokyo (JP)

(73) Assignee: Kioritz Corporation, Tokyo (JP)

( * ) Notice: Subject to any disclaimer, the term of this patent is extended or adjusted under 35 U.S.C. 154(b) by 87 days.

(21) Appl. No.: 10/829,197

(22) Filed: Apr. 22, 2004

(65) Prior Publication Data

US 2004/0240999 A1 Dec. 2, 2004

(30) Foreign Application Priority Data

Apr. 25, 2003 (JP) ..... 2003-122048

(51) Int. Cl.
*F04D 29/66* (2006.01)

(52) U.S. Cl. ..... 416/181; 416/185

(58) Field of Classification Search ..... 415/119; 416/181, 185, 188
See application file for complete search history.

(56) References Cited

U.S. PATENT DOCUMENTS

| | | | | |
|---|---|---|---|---|
| 998,889 | A * | 7/1911 | Fraser | 416/181 |
| 2,307,312 | A * | 1/1943 | Whiting | 451/548 |
| 3,165,257 | A * | 1/1965 | Edwards | 415/200 |
| 4,186,320 | A * | 1/1980 | Hillman | 310/93 |
| 2002/0060107 | A1 | 5/2002 | Kamoshita et al. | |

FOREIGN PATENT DOCUMENTS

| | | |
|---|---|---|
| DE | 44 03 224 A1 | 8/1995 |
| WO | WO 95/21330 | 8/1995 |

* cited by examiner

*Primary Examiner*—Ninh H. Nguyen
(74) *Attorney, Agent, or Firm*—Nixon Peabody LLP; Donald R. Studebaker

(57) ABSTRACT

It is the object of the present invention to provide a centrifugal blower fan capable of reducing a noise in an operating rotational speed range without degradation in blàwer performance. A centrifugal blower fan comprises a base plate, and a plurality of fan blades arranged on the base plate in a radial pattern to define a plurality of air passages between the pairs of adjacent fan blades, respectively. A portion of the base plate serving as a bottom wall of each of the air passages is formed with a plurality of through-holes.

4 Claims, 5 Drawing Sheets

CENTRIFUGAL BLOWER FAN

FIELD OF THE INVENTION

The present invention relates to a fan and more specifically to a centrifugal blower fan.

BACKGROUND OF THE INVENTION

In a small-size blower machine, such as a back-pack-type power sprayer for powder or liquid form chemical by airflow (airstream) discharged from a blower, or a back-pack-type blower for blowing fallen leaves or dust by airstream discharged from a blower, the blower has a fan disposed in a fan case. The fan comprises a base plate, and a plurality of blades arranged on the base in a radial pattern to define a plurality of air passages between the pairs of adjacent blades, respectively. Upon rotation of the fan, air is sucked from a center hub, and discharged to a spiral chamber defined by the fan case through the air passages.

Generally, in operation, the fan generates noise offensive to the operator's ear. Thus, it is desired to minimize such a noise.

SUMMARY OF THE INVENTION

It is therefore an object of the present invention to provide a centrifugal blower fan capable of reducing a noise in an operating rotational speed range without degradation in blower performance.

In order to achieve objects of the present invention, a centrifugal blower fan is provided comprising a base plate, and a plurality of blades arranged on the base plate in a radial pattern to define a plurality of air passages between pairs of adjacent blades, respectively. In the centrifugal blower fan of the present invention, a portion of the base plate serving as a bottom wall of each of the air passages, is formed with a plurality of through-holes. As compared to a conventional centrifugal blower fan, the centrifugal blower fan of the present invention can achieve noise reduction while preventing degradation in blower performance.

In one exemplary embodiment of the present invention, the plurality of through-holes are formed only in the range of approximately one-half the length of the bottom wall located downstream of the airstream flowing through the air passage. According to the centrifugal blower fan of this embodiment, the through-holes are arranged only in the downstream region of the air passage. This makes it possible to facilitate noise reduction without lowering the air pressure in the upstream region of the air passage or in the air inflow region, or without degradation in blower performances.

In another exemplary embodiment of the present invention, the through-hole located at the most downstream portion of the air passage has an inner diameter greater than the inner diameter of the through-hole located upstream relative to the most downstream through-hole. This makes it possible to suppress the occurrence of resonant vibration so as to facilitate noise reduction.

DETAILED DESCRIPTION

With reference to the drawings, an embodiment of a centrifugal blower fan according to the present invention will now be described. The centrifugal blower fan of the present invention can be employed for example in a small-size blower machine, such as a back-pack type power applicator or a back-pack type blower cleaner.

Figure 1:
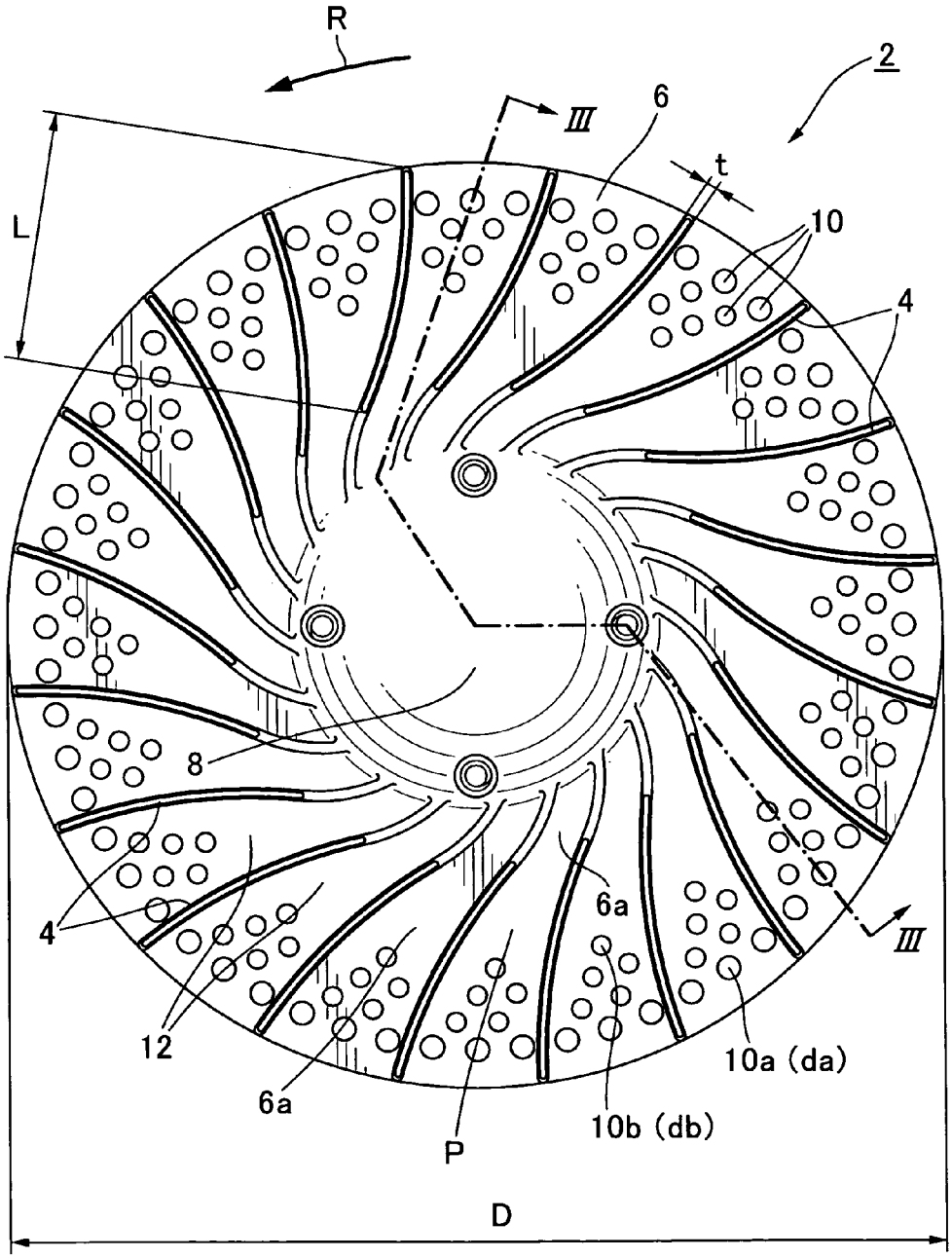
FIG. 1 is a plan view of a centrifugal blower fan according to one embodiment of the present invention.
Figure 2:
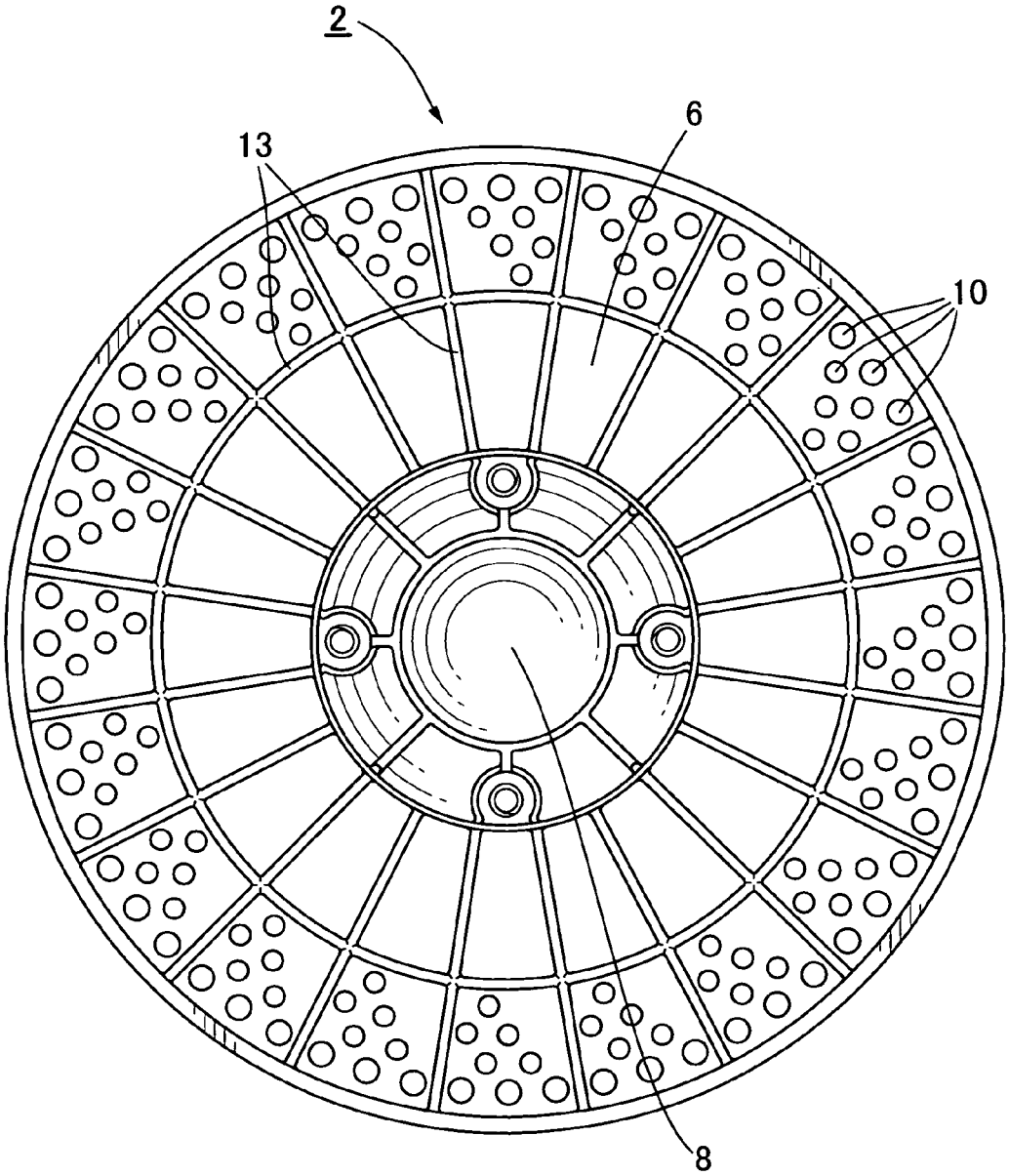
FIG. 2 is a bottom view of the centrifugal blower fan in FIG. 1.
Figure 3:
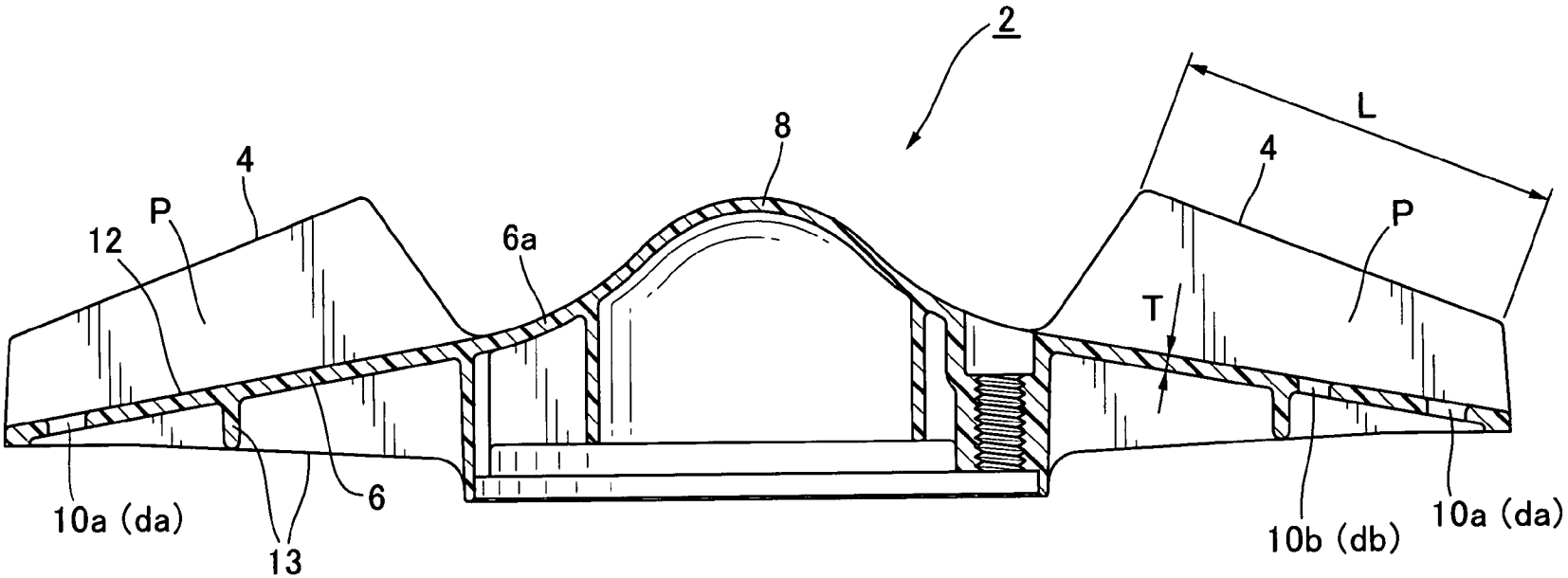
FIG. 3 is an enlarged sectional view taken along the line III—III in FIG. 1.

As shown in FIG. 1, the centrifugal blower fan 2 according to this embodiment is a radial flow type in which each of fan blades 4 curvedly extends in a direction opposite to the rotation direction (counterclockwise rotation direction as indicated by the arrow R in FIG. 1) of the fan 2, or in a clockwise rotation in top plan view. The fan 2 comprises a base plate 6, and the plurality of fan blades 4 are each upstandingly formed on the base plate 6. The base plate 6 and the fan blades 4 are integrally molded using synthetic resin. As shown in FIGS. 2 and 3, the fan has a bottom surface formed with reinforcing ribs 13 for preventing warp or deformation of the base plate 6.

The base plate 6 has a center hub 8 to be attached to a rotor shaft of a drive motor (not shown). As shown in FIG. 3, the top surface 6*a* of the base plate 6 is formed as an inclined surface extending downward in the radially outward direction from the hub 8 having the greatest height. In a centrifugal blower fan for use in a back-pack-type power applicator or a back-pack-type blower cleaner, the base plate typically has a diameter of about 150 to 300 mm.

The fan blades 4 are formed on the top surface of the base plate 6 to extend radially outward from the periphery of the hub 8 in a radial pattern. That is, the fan blades 4 are arranged in the radially outward region of the base plate 6 relative to the center hub 8. A plurality of air passages P are defined, respectively, between the pairs of adjacent fan blades 4 to allow air to flaw radially outward from the hub 8. Each of the air passages P has a sector-like shape that broadens toward the downstream portion of the passages.

As shown in FIG. 1, a portion 6*a* of the base plate 6 serving as the bottom wall 12 of each of the sector-shaped air passage P has a plurality of through-holes 10 each penetrating the bottom wall 12 in the axial direction of the rotor shaft. In accordance with an exemplary embodiment of the invention, the plurality of through-holes 10 are formed only in the range of approximately one-half the length of the downstream portion of the bottom wall 12 (located downstream as the airstream flows through the air passage P). In other words, the plurality of through-holes 10 are preferably formed only in the range of approximately one-third the radius (½×D) of the base plate 6 located downstream of the airstream flowing through the air passage P. Preferably, each of the through-holes 10 is formed to have an inner diameter in the range of about 4 to 6 mm.

Each of the through-holes 10 has a circular shape in cross section. Preferably, the through-holes 10 are formed in the bottom wall 12 located downstream portion of the airstream to have a greater number per area than that formed in the bottom wall 12 located upstream of the airstream. Further, the through-hole 10 located at the most downstream of the air passage P has an inner diameter da greater than the inner diameter db of the through-hole 10 located at the upstream relative to the most downstream through-hole 10.

EXAMPLE

A resin fan having the structure described with reference to FIGS. 1 to 3 and the following specific dimensions was prepared, and subjected to an experimental test according to the Japanese Industrial Standards (JIS).

(1) JIS B 8330 "Test and Inspection Process for Blowers"

| | |
|---|---|
| Test Apparatus | Blower using orifice plate (HIS 5.1 test apparatus FIG. 1a) |
| Rotational Speed | 5000 to 7000 rpm |
| Room Temperature during measurement | 12 C. |

(2) JIS B 8346 "Blowers and Compressors Measuring Process of Noise Level"

Fan Example (in accordance with an exemplary embodiment of the present invention)

| Structure of Fan | |
|---|---|
| Diameter (D) of Fan | 240 mm |
| Thickness (T) of Base Plate | 3 mm |
| Number of Fan Blades | 20 |
| Thickness (t) of Fan Blades | 3 mm |
| Length (L) of Fan Blades | 80 mm |
| Through-Hole | |
| Number (in respective lines arranged toward the upstream direction) | 3, 2, 2, 1 (total 8) |
| Cross-Sectional Shape | Circular Shape |
| Inner Diameter da (in the most downstream line) | 6 mm |
| db (in the remaining three upstream lines) | 5 mm |

Comparative Example 1

| Structure of Fan | |
|---|---|
| Diameter (D) of Fan | 240 mm |
| Thickness (T) of Base Plate | 3 mm |
| Thickness (t) of Fan Blades | 3 mm |
| Length (L) of Fan Blades | 60 mm |
| Number of Fan Blades | 20 |
| Hole with Bottom | |
| Number (in respective lines arranged toward the upstream direction) | 3, 2, 2, 1 (total 8) |
| Cross-Sectional Shape | Circular Shape |
| Inner Diameter da (in the most downstream line) | 6 mm |
| db (in the remaining three upstream lines) | 5 mm |
| Depth | 3 mm |

This hole was prepared by attaching an adhesive tape onto the bottom surface of the fan in the inventive example to close the bottoms of the through-holes.

Comparative Example 2

| Structure of Fan (conventional fan devoid of hole) | |
|---|---|
| Diameter (D) of Fan | 240 mm |
| Thickness (T) of Base Plate | 3 mm |
| Thickness (t) of Fan Blades | 3 mm |
| Length (L) of Fan Blades | 80 mm |

-continued

| Structure of Fan (conventional fan devoid of hole) | |
|---|---|
| Number of Fan Blades | 20 |
| Hole | None |

Figure 4:
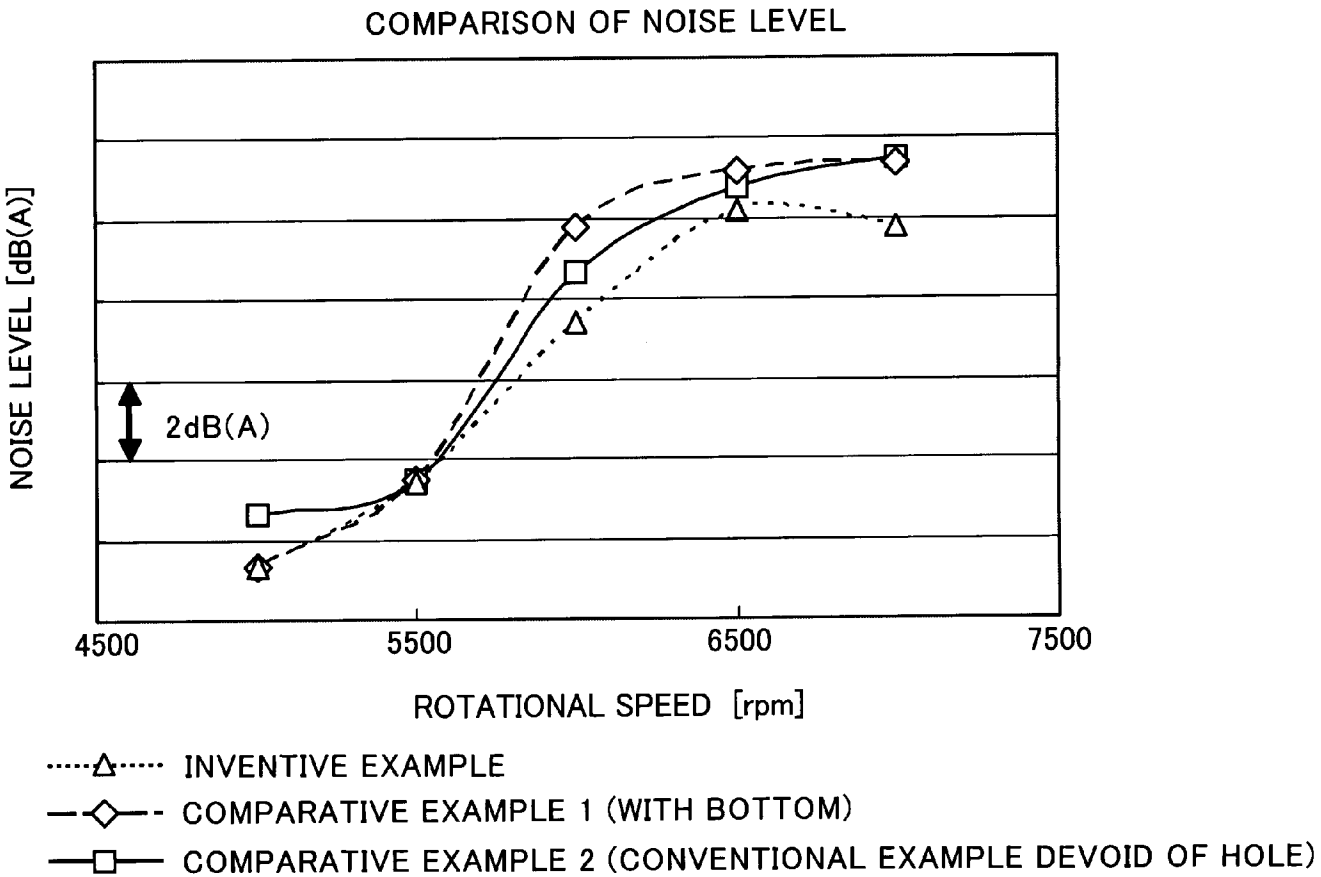
FIG. 4 is a graph showing a comparison result of noise level.
Figure 5:
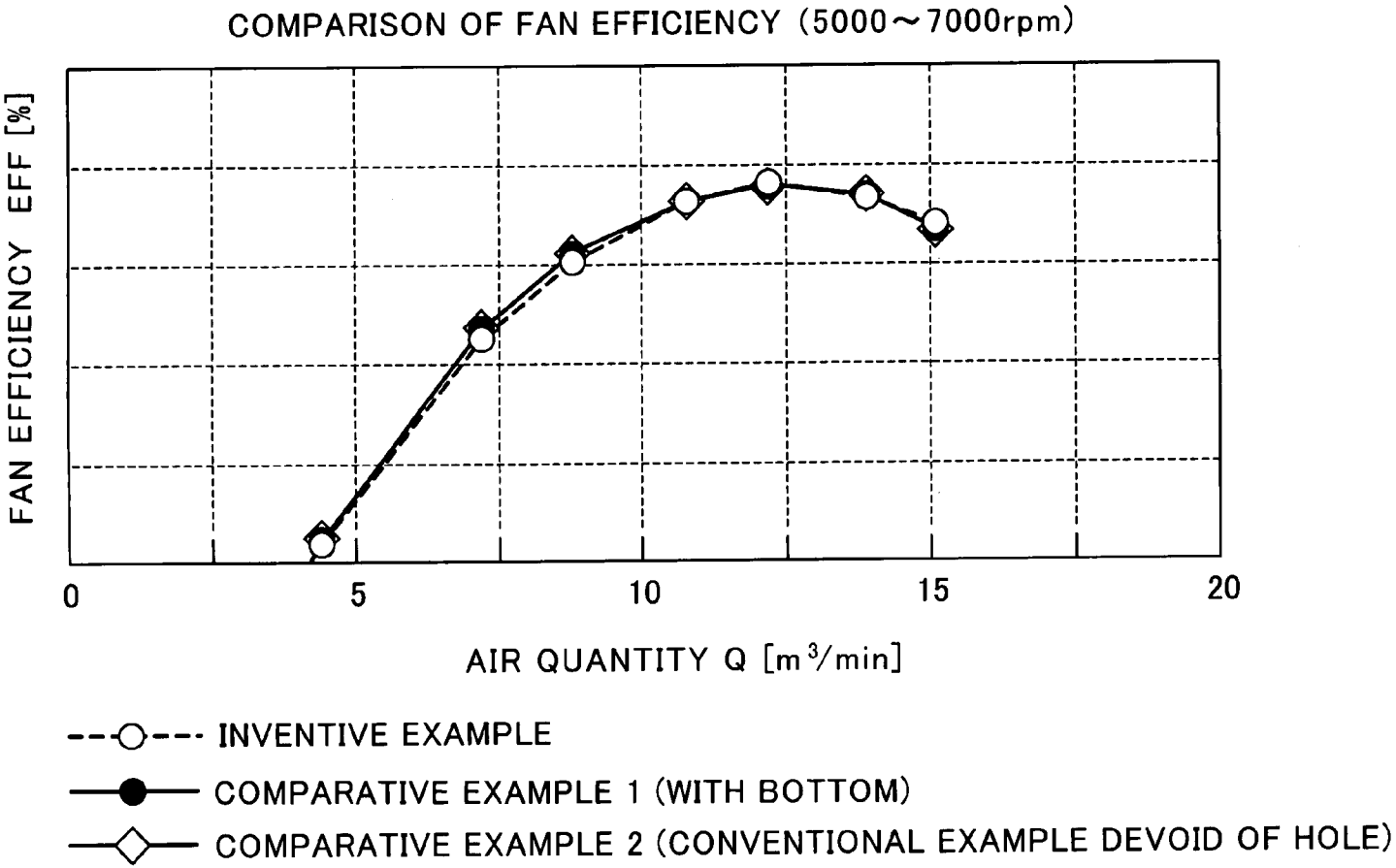
FIG. 5 is a graph showing a comparison result of fan efficiency.

The test results of the fan example and the comparative examples 1 and 2 are shown in FIGS. 4 and 5.

FIG. 4 shows the comparison result of noise level. As seen in FIG. 4, over the entire operating rotational speed range of 5000 to 7000 rpm, the fan example has a lower noise level than those of the comparative examples 1 and 2. In particular, a large difference is exhibited in the range of 6000 to 7000 rpm.

FIG. 5 shows the comparison result of fan efficiency calculated by the following formula:

Fan efficiency=(fan total pressure×air quantity×1.2)/shaft output.

The measurement values on fan efficiency as shown in FIG. 5 can be obtained over the entire operating rotational speed range of 5000 to 7000 rpm. As compared to the comparative examples 1 and 2, no degradation in fan efficiency was observed in the fan example. In particular, even in the comparison with the comparative example 2 using the fan devoid of holes, substantially no degradation in fan efficiency is observed in the fan example.

The present invention is not limited to the above embodiment, but various modifications can be made without departing from the spirit and scope of the present invention set forth in appended claims. It is understood that such modifications are also encompassed within the scope of the present invention.

For example, while the through-holes 10 are preferably formed only in the range of approximately one-half the length of the bottom wall 12 of the base plate 6 located downstream of the airstream flowing through the air passage P, they are not necessarily formed entirely over the above region but only in the downstream end of the air passage P.

Further, in order to provide enhanced fan efficiency, a doughnut-shaped side plate may be provided on the fan 4. In this case, the through-holes can be formed in the base plate 6 to obtain the same noise reduction effect.

What is claimed is:

1. A centrifugal blower fan comprising:

a base plate; and a plurality of blades arranged on said base plate in a radial pattern to define a plurality of air passages between the pairs of adjacent blades, respectively, wherein a portion of said base plate, serving as a bottom wall of each of said air passages, is formed with a plurality of through-holes;

wherein said plurality of through-holes are formed only in the range of approximately one-half the length of a downstream portion of said bottom wall.

2. The centrifugal blower fan as defined in claim 1, wherein the through-hole located at the most downstream portion of said air passage has an inner diameter greater than the inner diameter of a through-hole located upstream of said most downstream through-hole.

3. A centrifugal blower fan comprising:

a base plate; and a plurality of blades arranged on said base plate in a radial pattern to define a plurality of air passages between the pairs of adjacent blades, respectively, wherein a portion of said base plate, serving as a bottom wall of each of said air passages, is formed with a plurality of through-holes;

wherein the through-hole located at the most downstream portion of said air passage has an inner diameter greater than an inner diameter of a through-hole located upstream of said most downstream through-hole.

4. The centrifugal blower fan as defined in claim 3, wherein said plurality of through-holes are formed only in the range of approximately one-half the length of a downstream portion of said bottom wall.

* * * * *